US008872669B2

(12) United States Patent
Stibich et al.

(10) Patent No.: US 8,872,669 B2
(45) Date of Patent: Oct. 28, 2014

(54) DOOR MOVEMENT SENSORS AND USE THEREOF BY APPARATUSES

(75) Inventors: Mark Andrew Stibich, Houston, TX (US); Brian Cruver, Austin, TX (US); Morris Miller, Austin, TX (US); Kieron Hiuhon Tse, Chicago, IL (US); Brian Blankstein, Chicago, IL (US); Alexander Nathan Garfield, Chicago, IL (US); Martin Rathgeber, Chicago, IL (US); James Blaine Wolford, Chicago, IL (US)

(73) Assignee: Xenex Disinfection Services, LLC, San Antonio, TX (US)

( * ) Notice: Subject to any disclaimer, the term of this patent is extended or adjusted under 35 U.S.C. 154(b) by 566 days.

(21) Appl. No.: 13/171,063

(22) Filed: Jun. 28, 2011

(65) Prior Publication Data

US 2013/0002445 A1 Jan. 3, 2013

(51) Int. Cl.
*G08B 21/00* (2006.01)
*E05F 15/20* (2006.01)

(52) U.S. Cl.
CPC ..... *E05F 15/20* (2013.01); *E05Y 2400/80* (2013.01); *E05Y 2400/456* (2013.01)
USPC ..... 340/686.6; 340/545.1

(58) Field of Classification Search
None
See application file for complete search history.

(56) References Cited

U.S. PATENT DOCUMENTS

| | | | | |
|---|---|---|---|---|
| 6,203,060 | B1 | 3/2001 | Cech et al. | |
| 6,962,239 | B2 | 11/2005 | Shikai et al. | |
| 8,446,278 | B2 * | 5/2013 | Ivashin et al. | 340/545.2 |
| 2003/0085631 | A1 | 5/2003 | Cech et al. | |
| 2004/0140782 | A1 * | 7/2004 | Okabe et al. | 318/445 |
| 2006/0244403 | A1 | 11/2006 | Christensson et al. | |
| 2009/0058711 | A1 * | 3/2009 | Dixon et al. | 342/28 |
| 2009/0135015 | A1 * | 5/2009 | Dobson et al. | 340/572.9 |

FOREIGN PATENT DOCUMENTS

| | | |
|---|---|---|
| EP | 0582733 | 2/1994 |
| EP | 0908594 | 4/1999 |
| EP | 1713160 | 10/2006 |
| EP | 2003277 | 12/2008 |
| EP | 2003277 A2 * | 12/2008 |

OTHER PUBLICATIONS

International Preliminary Report on Patentability mailed May 17, 2013 for PCT/US2012/044406.
International Search Report & Written Opinion mailed Oct. 25, 2012 for PCT/US2012/044406.

* cited by examiner

*Primary Examiner* — Travis Hunnings
(74) *Attorney, Agent, or Firm* — Mollie E. Lettang; Daffer McDaniel LLP

(57) ABSTRACT

Devices are provided which include a component assembly for detecting inward, outward and sideways door movement. A component of the assembly extending from a structure comprises a distal end for contacting a door face when the structure is arranged in proximity to the door face. Systems are provided which include a portable stand, a door movement sensor attached to the stand, a proximity sensor, and a user interface. The system is configured to transmit signals to the user interface when the proximity sensor has been placed a predetermined distance from a door face and when door movement occurs. Apparatuses are provided which include program instructions for receiving input regarding a number of entryways of a room and inhibiting commencement of a task for which an apparatus arranged in the room is configured to perform until a number of signals received from a door movement sensor equals the number of entryways.

36 Claims, 2 Drawing Sheets

DOOR MOVEMENT SENSORS AND USE THEREOF BY APPARATUSES

BACKGROUND OF THE INVENTION

1. Field of the Invention

This invention generally relates to devices for detecting door movement and, more specifically, to door movement sensors and their use to affect operations of an apparatus.

2. Description of the Related Art

The following descriptions and examples are not admitted to be prior art by virtue of their inclusion within this section.

Sensors for detecting door movement and/or opening or closing of doors are used in a variety of applications, such as security systems, refrigerators, and rooms containing X-ray computed tomography. The placement of such systems and devices is generally static and, thus, sensors used for detecting door movement are not generally transferred among different locations. In fact, most conventional door movement sensors are mounted to a door, a door frame and/or a wall surrounding a door. The mounting of the sensors is generally cumbersome and includes many parts and, thus, it is not generally desirable to remove mounted sensors for use on other doors. Accordingly, most conventional door movement sensors are not used in a portable manner. Due to their lack of portable use, most door movement sensors are not versatile in regard to the door type or the door material for which they are to be used. In particular, some door movement sensors are applicable for doors which open inward and/or outward but are not applicable for sliding door configurations and vice versa. Moreover, some door movement sensors require attachment to a door via screws bored into a door. Such attachment means is suitable for wood doors, but not for glass or metal doors and, thus, some door movement sensors are not applicable for many different door materials. Consequently, conventional door movement sensors are of limited use.

SUMMARY OF THE INVENTION

The following description of various embodiments of devices, systems and apparatuses is not to be construed in any way as limiting the subject matter of the appended claims.

Embodiments of devices for detecting movement of a door include a component assembly for detecting inward, outward and sideways door movement and a support structure holding the component assembly. The component assembly includes a first component extended or extendable from the support structure and further includes a distal end for contacting a door face when the support structure is arranged in proximity to the door face and when the first component is extended from the support structure.

Embodiments of systems include a portable floor stand, a door movement sensor fixedly attached to the portable floor stand, a proximity sensor comprising the door movement sensor or the portable floor stand, and a user interface. The system is configured to transmit a first signal from the proximity sensor to the user interface when the proximity sensor has been placed a predetermined distance from a door face. In addition, the system is configured to transmit a second signal from the door movement sensor to the user interface when movement of the door occurs.

Embodiments of apparatuses include a wireless signal receiver, a processor and a storage medium having program instructions which are executable by the processor for receiving input regarding a number of entryways of a room in which the apparatus is arranged. The storage medium further includes program instructions executable by the processor for recording receipt of a wireless signal from a door movement sensor device arranged in proximity to a face of a closed door to one of the entryways of the room. In addition, the storage medium further includes program instructions executable by the processor for inhibiting commencement of a task for which the apparatus is configured to perform until the number of recorded signal receipts equals the number of entryways.

BRIEF DESCRIPTION OF THE DRAWINGS

Other objects and advantages of the invention will become apparent upon reading the following detailed description and upon reference to the accompanying drawings in which.

Figure 1:
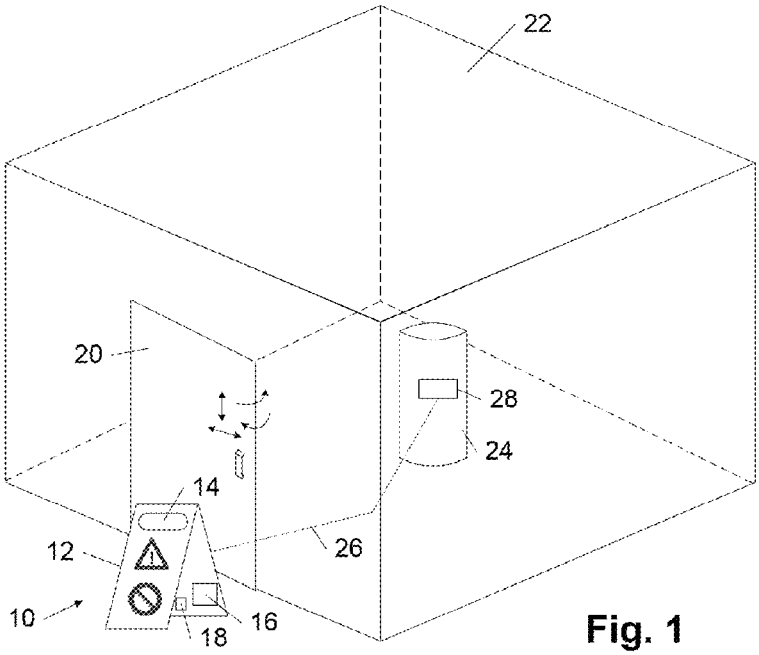
FIG. 1 is a perspective view of a portable floor stand comprising a door movement sensor arranged in proximity to an outer face of a closed door to a room in which an apparatus is arranged.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Turning to the drawings, FIG. 1 depicts system 10 including door movement sensor 16 fixedly attached to portable floor stand 12, which is arranged in proximity to closed door 20 of room 22. As described in more detail below, portable floor stand 12 or door movement sensor 16 may include a proximity sensor for ascertaining a position of portable floor stand 12 or door movement sensor 16 relative to a surface, such as door 20. In addition, system 10 may include a user interface and may be configured to transmit signals from the proximity sensor and the door movement sensor to the user interface to indicate when the proximity sensor has been placed a predetermined distance from a door face and when movement of the door occurs. As further shown in FIG. 1, apparatus 24 may be arranged within room 22. As described below, apparatus 24 and system 10 may, in some embodiments, be in wireless communication with each other, which is denoted in FIG. 1 by dotted line 26. It is noted that FIG. 1 merely illustrates an example of how system 10 may be configured and used. Other system configurations and uses may be employed as set forth in more detail below. In accordance with such a declaration, it is noted that all of the devices, systems and apparatuses described herein are not limited to the depictions in the drawings. Furthermore, it is noted that the drawings are not necessarily drawn to scale.

Different configurations of door movement sensors which may be considered for door movement sensor 16 and more generally for the systems and devices described herein are discussed in reference to FIGS. 3-7. As set forth in reference to FIGS. 3-7, door movement sensor 16 may, in some embodiments, be configured to detect inward, outward and sideways door movement to offer versatility to the types of doors with which the movement sensor is compatible. In further cases, door movement sensor 16 may be additionally configured to detect upward and downward door movement to offer even more versatility to the types of doors with which the movement sensor is compatible. It is noted that other configurations of door movement sensor 16 may be considered for the systems and devices described herein and, in particular, door movement sensor 16 may be configured to detect movement in a single direction or any combination of directions. In accordance thereto, door 20 of room 22 in FIG. 1 may be of a variety of configurations, including configurations for opening inward and/or outward (i.e., door 20 may comprise a hinge secured to one edge of the door) and configurations for sliding (i.e., door 20 having one or more tracks for the door to slide up and down or sideways). The different directions door 20 may be configured to move are denoted by arrows on door 20 in FIG. 1.

As noted above and as shown in FIG. 1, door movement sensor 16 is fixedly attached to portable floor stand 12. The adaptation of stand 12 to be floor based offers an effective manner in which to deter access to room 22 and monitor movement of door 20 while affecting portability to system 10. In particular, as shown in the example illustrated in FIG. 1, portable floor stand 12 may be configured to block door 20 at least in part and, in some embodiments, may include warning and/or usage signs to deter an individual from entering room 22. In addition, a floor based stand provides a structure to support door movement sensor 16 and bring it in proximity to door 20 without having to mount the door movement sensor such as on the door, the door frame or a wall around the door. In embodiments in which system 10 is in wireless communication with apparatus 24, the adaptation of stand 12 to be floor based offers remote control of apparatus 24, but promotes use thereof in proximity to door 20. Such a configuration is advantageous over a remote control device designed for portability with a user due to the high chances of such a device being carried away with a user and, in effect, preventing another individual from controlling the operation of apparatus 24 (such as terminating its operation) exterior to room 22. Although portable floor-based stand 12 affects many benefits to system 10, system 10 need not be restricted to inclusion of a floor-based stand, but rather may generally include a stand configured for arrangement in proximity to a door, including being attached to the door, the door frame or a wall in proximity to the door.

As noted above, system 10 may include a user interface. In some embodiments, the user interface may be integrated into portable floor stand 12 as shown in FIG. 1 by user interface 14. In other embodiments, however, the user interface of system 10 may be remote from portable floor stand 12. Remote user interfaces may be integrated into a variety of devices including but not limited to hand held communication devices (i.e., Pagers, telephones, etc.) and computers. Regardless of whether a user interface is integrated into or remote from portable floor stand 12, the user interface of system 10 may generally be configured to receive signals and output information pertaining to such signals to a user in informative manner. Configurations to output the information may include any visual display or audible means known in the art. In some embodiments, as set forth in more detail below, the user interface of system 10 may further include input controls to affect operation of system 10 and/or apparatus 24. Configurations to input information may include any of those known in the art, including but not limited to touch sensor means, audible means, and graphical user interfaces. An exemplary configuration of interface 14 of FIG. 1 is described in more detail below in reference to FIG. 2. but it is noted that such a configuration is merely an example and, thus, the user interfaces considered for the systems described herein should not be restricted to the illustration of FIG. 2.

As further noted above, door movement sensor 16 or portable floor stand 12 may include a proximity sensor configured to transmit a signal to a user interface when the proximity sensor has been placed a predetermined distance from a door face. The predetermined distance may be set based on an acceptable position of door movement sensor 16 for detecting movement of door 20, which will be dependent on the characteristics of door movement sensor 16 and, thus, may vary among applications. The proximity sensor may be of a variety of configurations. For example, in some embodiments, the proximity sensor may include a distance sensor fixedly attached to the backside of portable floor stand 12 or may include a distance sensor as a component of door movement sensor 16. In either case, the distance sensor may be used to determine the distance at which portable floor stand 12 or door movement sensor 16 is arranged relative to a surface, such as door 20. Then, upon detecting a predetermined distance has been obtained, the distance sensor may send a signal (via a wire or wireless connection) to a user interface of system 10 to indicate portable floor stand 12 and/or door movement sensor 16 is in an acceptable position for monitoring door movement. In alternative cases, particularly in embodiments in which door movement sensor 16 includes an extended or extendable component to be brought into contact with a door surface (as is described in reference to FIG. 3-7), the component of door movement sensor 16 may include a touch sensor configured to detect when the component makes contact with a surface. Upon contact, the touch sensor may send a signal (via a wire or wireless connection) to a user interface of system 10 to indicate door movement sensor 16 is in an acceptable position for monitoring door movement (otherwise stated, when door movement sensor 16 has been placed at a predetermined distance of zero from a door face).

In addition to a proximity sensor being in electrical communication with a user interface of system 10, door movement sensor 16 may be in electrical communication with the user interface via a wire or wireless connection to indicate when door movement occurs. Although larger thresholds of door movement may be set for a door movement sensor to send such a signal, the door movement sensors considered herein are preferably configured to send a door movement signal upon detecting less than approximately 5 cm of movement and, in some embodiments, approximately 1 cm of movement. Further to such a communication link to a user interface of system 10, in embodiments in which system 10 is used to control the operation of apparatus 24, system 10 may include a wireless signal transmitter coupled to door movement sensor 16 or portable floor stand 12 to transmit a signal to terminate operation of apparatus 24 when movement of the door occurs. In some cases, apparatus 24 may additionally or alternatively include one or more motion detectors (i.e., integrated within apparatus 24 or remote from apparatus 24) for detecting motion in room 22. The motion detector/s may be used to terminate operations of apparatus 24 when an individual has entered room 22. As such, in embodiments in which door movement sensor 16 is in wireless communication with apparatus 24 to indicate when door movement occurs, the one or more motion sensors may serve as back-up devices to terminate operations of apparatus 24.

In some cases, apparatus 24 may include a wireless signal transmitter configured to transmit signals to the user interface of system 10 when operation of the apparatus starts and when operation of the apparatus has terminated. In addition, a wireless signal transmitter included in apparatus 24 may be configured to transmit signals to user interface of system 10 when apparatus 24 is in operation, particularly in regard to a specific task. Dotted line 26 is provided in FIG. 1 to illustrate exemplary wireless connections between apparatus 24 and door movement sensor 16 and/or interface 14 of portable floor stand 12. In some embodiments, system 10 may include a portable communication device (e.g., a pager, telephone, etc.) distinct from the user interface referenced above. In such cases, a wireless signal transmitter of apparatus 24 and/or user interface of system 10 may be configured to transmit a signal to the portable communications device when operation of the apparatus has terminated.

Figure 2:
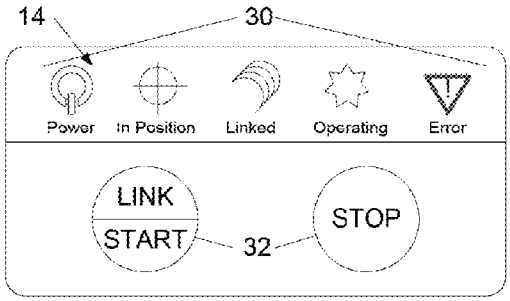
FIG. 2 depicts an exemplary configuration of a user interface for the portable floor stand depicted in FIG. 1.

As noted above, portable floor stand 12 may, in some embodiments, include user interface 14, an exemplary configuration of which is illustrated in FIG. 2 including electronic display 30 and input controls 32. As noted above, a user interface of system 10 may include any number and type of indicators and input controls depending on the design configurations of system 10 (including audible and visual indicators and controls) and, thus, user interface 14 is not limited to the configuration shown in FIG. 2. Furthermore, user interface 14 is not restricted to being integrated within portable floor stand 12, but rather may be disposed on a remote device. In general, input controls 32 may include controls to affect operation of apparatus 24, such as but not limited to a start and stop button to enable a user to remotely start and terminate an operation of apparatus 24. As shown in FIG. 2, input controls 32 may optionally include a link button, referring to a process in which apparatus 24 has knowledge that system 10 is in an acceptable position to monitor movement of door 20. Such a process is particularly applicable when a room has multiple doors as described in more detail below in reference to FIG. 8. It is noted that the link button may be integrated with a start button as shown in FIG. 2 or may be an independent input control. In other embodiments, user interface 14 may be void of input controls 32 and electrical connection to apparatus 24. In particular, system 10 does not necessarily need to be used in conjunction with an apparatus. Rather, system 10 may be simply be used to detect door movement and/or deter access to room 24 and, thus, input controls 32 may not be needed.

As shown in FIG. 2, electronic display 30 may include a plurality of lighted indicators used to indicate the status of floor stand 12, door movement sensor 16 and, in some embodiments, apparatus 24. In particular, electronic display 30 may include a power indicator denoting whether user interface 14 is on. In addition, electronic display 30 may include an "in position" light to indicate when system 10 is an acceptable position for detecting movement of door 20 or, more specifically, when portable floor stand 12 and/or door movement sensor 16 has been placed a predetermined distance from a door face. Furthermore, electronic display 30 may include an "error" indicator light for indicating when door movement occurs. In some cases, the "error" indicator light on electronic display 30 may be used to indicate an error in operation of apparatus 24 (such as but not limited to bulb failure or motion detection in room 22) when system 10 is in electrical communication therewith. Alternatively, electronic display 30 may include a different indicator for operational errors of apparatus 24.

In some embodiments, electronic display 30 may include additional indicators regarding the operations of apparatus 24 (i.e., operations other than on and off). For example, as shown in FIG. 2, electronic display 30 may include an indicator for indicating when system 10 is "linked" to apparatus 24, specifically referring to apparatus 24 having knowledge that system 10 is in an acceptable position to monitor movement of door 20. Such a process is particularly applicable when a room has multiple doors as described in more detail below in reference to FIG. 8. In addition or alternatively, electronic display 30 may include an "in operation" indicator for indicating when apparatus 24 is in operation, particularly with regard to a specific task. In some embodiments, the time remaining for apparatus 24 "in operation" may be displayed on electronic display 30. An example of an "in operation" event is when an ultraviolet room disinfection apparatus is in the process of generating and projecting ultraviolet light within room 22. As described in more detail below, an ultraviolet room disinfection apparatus is one of a variety of different options for apparatus 24.

In general, apparatus 24 may include any type of apparatus. The term apparatus as used herein refers to an instrument, an appliance, a set of materials or one or more pieces of equipment designed for a specific use or operation. In some embodiments, it may be particularly applicable to utilize system 10 in conjunction with an apparatus intended for use in an area of limited or no human occupancy and, more specifically, a portable apparatus used in such a manner. Examples of applicable apparatuses include but are not limited to those which utilize and/or generate x-rays, ultraviolet light and/or radioactive materials, particularly into the ambient of the apparatus. A particularly suitable example of an applicable apparatus is an ultraviolet room disinfection apparatus. As used herein, the term "room disinfection" refers to the cleansing of a bounded area which is suitable for human occupancy so as to deactivate, destroy or prevent the growth of disease-carrying microorganisms in the area.

In general, ultraviolet room disinfection apparatuses are configured to generate and project ultraviolet light in a multidirectional and expansive manner within a room. The ultraviolet light deactivates and, in some cases, kills microorganisms, making it effective for disinfecting and/or sterilizing multiple items within a room. The light source used to generate the ultraviolet light may be of a variety of forms, including those which generate continuous light, such as mercury-vapor lamps, and those which generate light for very short durations, which are referred to herein as flashtubes or flashlamps. In some cases, the light source of an ultraviolet room disinfection apparatus may include a pulsed light source, which is a flashlamp configured to supply recurrent pulses of light. Furthermore, the light source may take on the form of a gas-discharge lamp, such as but not limited to a xenon flashtube, or a surface-discharge lamp.

Regardless of the configuration of apparatus 24, the apparatus may be arranged on an opposing side of a door from system 10 such that access to apparatus 24 is limited or barred during operation thereof For example, as shown in FIG. 1, apparatus 24 may be arranged within room 22 and system 10 may be arranged in proximity to the outward face of door 20 to deter entrance into room 22 when apparatus 24 is in operation. As used herein, the term "room" refers to a bounded area suitable for human occupancy. In some embodiments, one or more portable floor stands of a system may be arranged in proximity to inward faces of doors to a room. In particular, the time to place a plurality of floor stands in proximity to a plurality of entryways of a room may be lessened for a user if one or more floor stands are arranged in proximity to inward faces of doors to the room. More specifically, a user may open a door to place a warning sign on the outer face of a door if needed, but then close the door and position a floor stand in proximity to the inward face of the door. In doing so, movement of the door is still monitored by the system and, if applicable, an associated apparatus may be controlled in view of door movement. Furthermore, individuals exterior to the room are warned regarding entry into the room via the notices posted exterior to the entry ways. The benefit of such a process is that the user does not need to walk the exterior circumference of the room to position all of the floor stands in proximity to the entryways of the room, in effect saving time.

It is noted that although the devices, systems, and apparatuses discussed herein are specifically described in reference to use within rooms or for rooms, the devices, systems and apparatus may alternatively be adapted for use in non-room areas, such as those smaller than which can be occupied by humans and/or areas which are not bound by walls. In particular, the devices, systems and apparatuses described herein may be configured for use of any bounded area having a door, such as but not limited to a storage container. In such embodiments, the system may not necessarily include a floor-based stand, but rather may generally include a stand configured for arrangement outside of the bounded area. In addition, the devices, systems and apparatuses described herein may be configured for embodiments in which an apparatus is used outside. In such cases, access to the apparatus may be limited or barred via use of system 10 on the inward face of a door of a building adjacent to the area in which the apparatus is arranged.

As noted above, FIGS. 3-7 illustrate different exemplary configurations of door movement sensors which may be used for the devices and systems described herein. As set forth in more detail below, each of the configurations include a component assembly for detecting inward, outward and sideways door movement, which may provide versatility to a system or device to be used on a variety of door types. In some embodiments, the component assemblies may be further configured for detecting upward and downward door movement, which may provide further versatility to a system or device to be used on a variety of door types. Although such adaptabilities may be advantageous, the door movement sensors considered for the systems and devices described herein are not necessarily so limited. In particular, door movement sensors which are configured to detect movement in any combination of directions or even a single direction may be considered for the systems and devices described herein and, thus, the application should not be limited to the depiction of the figures.

As an example, a door movement sensor considered for the systems and devices described herein may include only one component from the configurations described in reference to FIGS. 3-7 and still be applicable for detecting movement of a door. Configurations other than those described in reference to FIGS. 3-7 may also be considered for the use with the systems and apparatuses described herein. For example, a floor mat comprising a door movement sensor and which is configured for placement underneath a door may be considered for wireless communication with apparatus 24 to controlling operations thereof upon detection of door movement. In such cases, the floor mat may be distinct from a stand used to deter access through a door of a room and/or may not even be used in conjunction with such a stand. Further to such a notion, it is noted that the door movement sensors described herein do not necessarily need to be used in conjunction with a system (such as a portable floor stand) or an apparatus. Rather, the door movement sensors described herein may be used on their own rather than be incorporated into a system or be correlated with an apparatus.

In any case, each of the configurations of door movement sensors depicted in FIGS. 3-7 illustrates a top view of the sensors relative to a door, specifically door 20 in accordance with FIG. 1. In addition, each of the configurations discussed in reference to FIGS. 3-7 include a support structure holding the component assembly configured to detect movement of a door. The support structure is referenced as portable floor stand 12 in accordance with FIG. 1, but any support structure may be used to hold a component assembly. Moreover, the door movement sensor in each of the configuration of FIGS. 3-7 is referenced as door movement sensor 16 in accordance with FIG. 1. As shown in FIGS. 3-7, each of the components assemblies for detecting door movement includes a component extended or extendable from the support structure, wherein the component comprises a distal end for contacting a face of door 20 when the support structure is arranged in proximity to the door face and when the component is extended from the support structure. The design of such a component differs among the configurations of FIGS. 3-7 and, thus, is the emphasis in the description of each of the figures.

Figure 3:
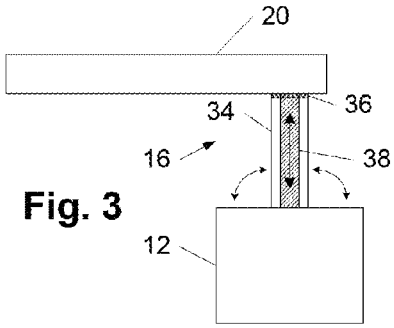
FIG. 3 depicts a top view of an exemplary configuration for the door movement sensor depicted in FIG. 1 comprising an elastic element embedded cantilever component pivotable at its supported end.

Turning to FIG. 3, door movement sensor 16 is shown including component 34 extending from portable floor stand 12. In general, component 34 may be a cantilever structure suspended above a floor upon which portable floor stand 12 is arranged. As shown in FIG. 3, component 34 includes a distal end 36 in contact with door 20, which may in some embodiments be roughened to increase friction at the interface of distal end 36 and door 20. Such a configuration may be preferable over using adhesives or suction cups at the distal end of component 34 since a roughened surface is generally reusable and suitable for many different door materials. On the contrary, adhesives have generally limited reuse and suction cups are generally material specific. As shown by the two curved arrows in FIG. 3, the supported end of component 34 may be pivotable at portable floor stand 12 to affect sideways movement of component 34 along a plane parallel with the floor. In such cases, when distal end 36 is in contact with door 20 and when door 20 is moved sideways (such as in a configuration of a sliding door), the pivotable configuration of component 34 may affect sideways movement of component 34. In this manner, door movement sensor 16 may detect sideways movement of door 20 via detection of component 34 moving. In alternative configurations, the supported end of component 34 may be pivotable at portable floor stand 12 to affect up and down movement of component 34, which in turn may be used to detect up and down movement of door 20. In yet other embodiments, supported end of component 34 may be pivotable in two dimensions to affect sideways as well as up and down movement of component 34 (i.e., a configuration comparable to a joystick). In yet further embodiments, supported end of component 34 may be rotationally pivotable. In either of the latter two cases, component 34 may be versatile for application on doors which slide sideways or up and down.

FIG. 3 further shows component 34 including elastic element 38 to affect inward and outward movement of component 34 when door 20 is moved inward or outward (such as in a configuration of door 20 comprising a hinge). As used herein, the term "elastic element" refers to a component which is capable via material and/or structural design to be returned to its original length, shape, etc., after being stretched, deformed, compressed, or expanded. In general, the elastic elements considered for the applications of the door movement sensors described herein are suitably pliable such that an element may be stretched, contracted, compressed or uncompressed by movement of a door in contact with the element. The pressure incurred by door movement will depend on the size and weight of a door and, thus, the characteristics of an elastic element to change its shape in response to such pressure may vary depending on the design specifications of the device. In some embodiments, it may be advantageous to configure door movement sensor 16 to be applied to a variety of door types and, thus, it may be advantageous to utilize an elastic element which changes shape upon application of a relatively low amount of pressure. Examples of elastic elements which may be utilized for element 38 include compression buttons, compression springs, extension springs, and combination compression and extension springs, but other elastic components known in the art may be utilized.

In any case, in embodiments in which door 20 opens inward, elastic element 38 may be compressed prior to component 34 being placed in contact with door 20 such that when door 20 moves the release of elastic element 38 (i.e., the movement of elastic element 38 to an uncompressed or less compressed state) indicates movement of the door. In other cases in which door 20 opens inward, elastic element 38 may be in its original (i.e., relaxed or normal) state when door 20 is closed and then may be stretched when door 20 is moved and such stretching movement may be used to indicate door movement. In yet other embodiments, door 20 may be configured to open outward. In such cases, elastic element 38 may, in some embodiments, be in an uncompressed or lightly compressed state when placed against a door face and then movement of door 20 may be indicated when elastic element 38 is compressed or compressed further. Alternatively when door 20 is configured to open outward, elastic element 38 may be stretched when door 20 is closed and then when door 20 is moved, the elastic element may be released from such a state (i.e., unstretched or contracted in part) and such a release may be used to indicate door movement. In the latter of such embodiments, elastic element 38 may first be positioned in contact with a door face, such as by suction, and then stretched prior to monitoring movement of door 20.

Figure 4:
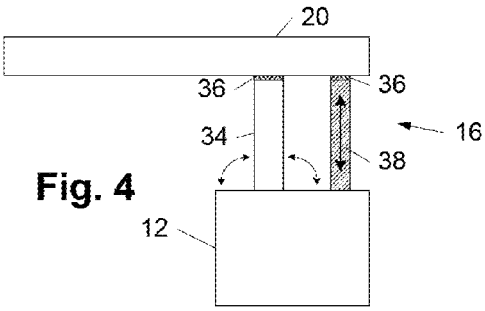
FIG. 4 depicts a top view of another exemplary configuration for the door movement sensor depicted in FIG. 1 including two cantilever components, one which is pivotable at its supported end and the other including an elastic element.

In some embodiments, the pivotable configuration of component 34 and elastic element 38 may be disposed as separate components in door movement sensor 16 such as shown in FIG. 4. In yet other embodiments, elastic element 38 may be disposed next to a flexible cantilevered fiber or wire serving as component 34 which upon bending indicates sideways or upward or downward movement of door 20. Regardless of whether component 34 and elastic element 38 are disposed as separated entities or integrated together within a component assembly, the combination of such elements allows door movement sensor 16 to be able to detect inward and outward door movement as well as sideways and/or up and down door movement in a single component assembly and, thus, may be applicable for use for a variety of door types.

Figure 5:
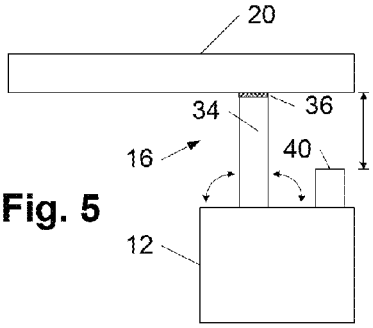
FIG. 5 depicts a top view of yet another exemplary configuration for the door movement sensor depicted in FIG. 1 including two sensors, one as a cantilever component which is pivotable at its supported end and other as a distance sensor.

In yet other embodiments, a different component may be used to detect inward and outward movement of door 20 rather than elastic element 38. In particular, as shown in FIG. 5, door movement sensor 16 may, in some embodiments, include distance sensor 40 configured to measure distances to a target object, such as door 20. The distance sensor may be used to detect distance changes for doors which open inward or outward. Thus, distance sensor 40 may be coupled with component 34 to affect versatility to door movement sensor 16 to detect inward and outward as well as sideways and/or up and down door movement in a single component assembly. It is noted that an appliqué may be needed to be attached to door 20 when an optical sensor is used for distance sensor 40 and when door 20 is glass to be able to ascertain changes in distances of the glass door and, thus, to be able to detect movement of the glass door.

Figure 6:
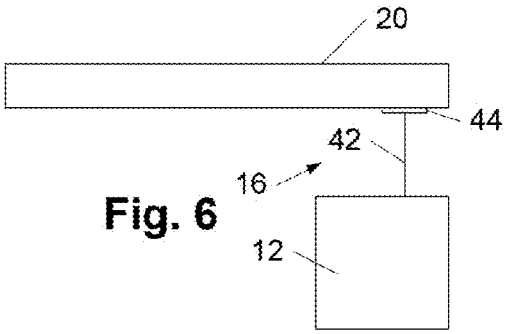
FIG. 6 depicts a top view of yet another exemplary configuration for the door movement sensor depicted in FIG. 1 including a cord extending between a support structure and a door.
Figure 7:
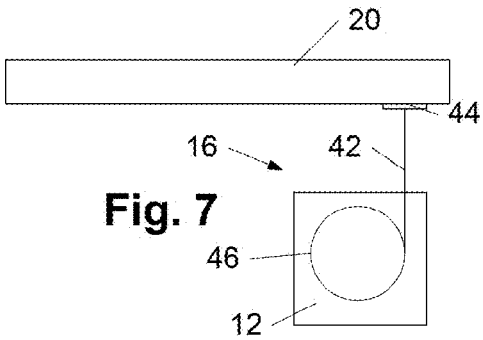
FIG. 7 depicts a top view of yet another exemplary configuration for the door movement sensor depicted in FIG. 1 including a corded reel.

Another configuration of door movement sensor 16 may include cord 42 having a plate 44 at its distal end adhered or suctioned to door 20 as shown in FIGS. 6 and 7. In some embodiments, the cord may be fixedly attached to a sidewall of portable floor stand 12 as shown in FIG. 6, but in other embodiments, the cord may extend from a corded reel 46 as shown in FIG. 7. In either case, the tension along the cord may be monitored as in indicator when door 20 is moved. In yet other embodiments, the rotational movement of corded reel 46 may be monitored to indicate movement of door 20. The corded embodiments of FIGS. 6 and 7 may be advantageous in that they effect detection of inward, outward, upward, downward and sideways door movement via a single component. The term cord as used in reference to the embodiments of FIGS. 6 and 7 may refer to any material which tension may be effectively monitored and which may be wound upon itself, including but not limited to metal wire, string and polymer fibers.

In some embodiments, the systems described herein may include additional components to detect movement of a door (i.e., in addition to door movement sensor 16). In particular, portable floor stand 12 may, in some embodiments, include auxiliary component 18 as shown in FIG. 1. In general, auxiliary component 18 may be configured to detect movement of portable floor stand 12 and may generally be used as a back-up device for detecting movement of door 20. More specifically, an auxiliary component on portable floor stand 12 may be used to indicate door 20 moving when movement of door 20 causes the floor stand to move. Such action may be applicable when portable floor stand 12 is arranged in contact and, in some cases, suctioned to door 20. In some embodiments, however, portable floor stand 12 may be designed to prevent contact with a door. Examples of devices for auxiliary component 18 include an accelerometer, a vibration sensor and a gyroscope.

As noted above, the systems and apparatuses described herein may include a linking process to insure all identified entryways to a room in which an apparatus is arranged are closed prior to the apparatus starting operation of a particular task. Such a process is particularly applicable when a room has multiple doors. In general, such a linking process may be incorporated into apparatus 24, specifically by including a wireless signal receiver configured to communicate with any number of portable floor stands and further via program instructions which are executable by a processor of apparatus 24. The program instructions may generally be stored in a storage medium of central processing unit 28 of apparatus 24 which is depicted in FIG. 1. In general, the term "storage medium", as used herein, may refer to any electronic medium configured to hold one or more set of program instructions, such as but not limited to a read-only memory, a random access memory, a magnetic or optical disk, or magnetic tape. The term "program instructions" may generally refer to commands within a program which are configured to perform a particular function, such as receiving input, recording receipts of signals, and determining whether to allow an apparatus to start an operation as described in more detail below. Program instructions may be implemented in any of various ways, including procedure-based techniques, component-based techniques, and/or object-oriented techniques, among others. For example, the program instructions may be implemented using ActiveX controls, C++ objects, JavaBeans, Microsoft Foundation Classes ("MFC"), or other technologies or methodologies, as desired. Program instructions implementing the processes described herein may be transmitted over on a carrier medium such as a wire, cable, or wireless transmission link.

Figure 8:
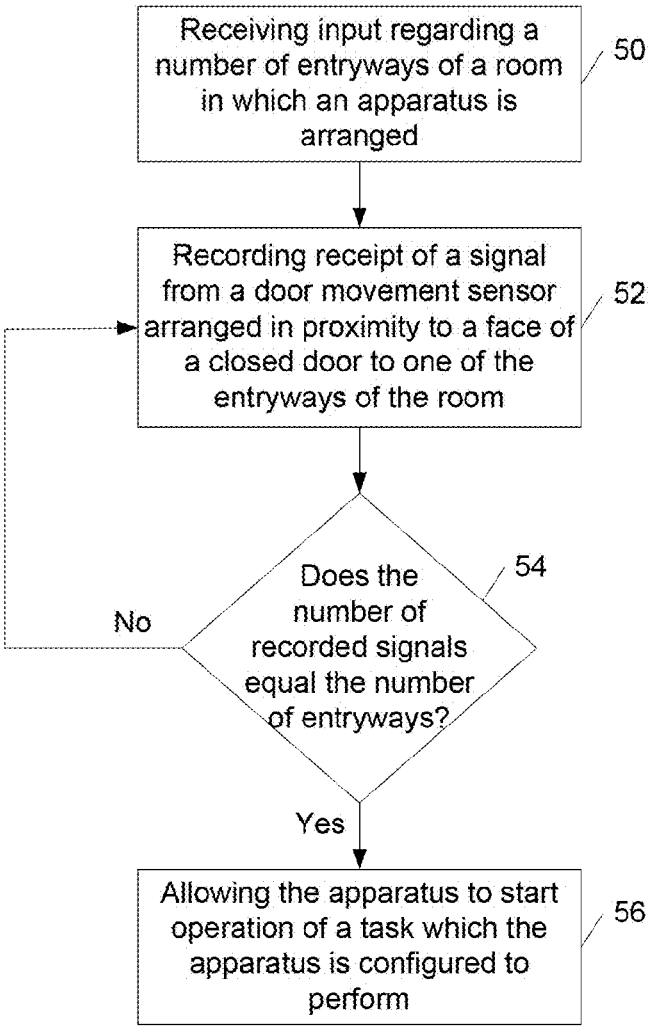
FIG. 8 depicts a flowchart for insuring all identified entryways to a room in which an apparatus is arranged are closed prior to starting operation of a task that the apparatus is configured to perform.

FIG. 8 illustrates a flow chart of an exemplary linking process. In particular, the process involves receiving input regarding a number of entryways of a room in which an apparatus is arranged as shown in block 50. The number may be input by a user of the device or may be preprogrammed in regard to the room in which the apparatus is arranged. In either case, the process proceeds to block 52 in which receipt of a wireless signal is recorded from a door movement sensor device arranged in proximity to a face of a closed door to one of the entryways of the room. The signal may generally be indicative that a door movement sensor has been placed in a position suitable for monitoring door movement for the corresponding door. The signal may be sent automatically from a system comprising the door movement sensor or may be sent upon input from a user of such a system. In any case, a determination is made at block 54 regarding whether the number of recorded signals equals the number of entryways. In cases in which it does not, the process reverts back to block 52 to record receipt of a signal from another door movement sensor. In doing so, commencement of a task by the apparatus is inhibited until the number of recorded signal receipts equals the number of entryways. As shown in block 56 of FIG. 8, when the number of recorded signals equals the number of entryways, the apparatus is allowed to automatically starting operation of the task.

It will be appreciated to those skilled in the art having the benefit of this disclosure that this invention is believed to provide door movement sensors and systems and apparatuses employing such sensors. Further modifications and alternative embodiments of various aspects of the invention will be apparent to those skilled in the art in view of this description. For example, although the aforementioned discussions emphasize arranging door movement sensors in proximity to an outward face of a door, the application of the devices and systems described herein are not necessarily so limited. In particular, the devices and systems described herein may alternatively use a door movement sensor arranged in proximity to an inward face of a door. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A device for detecting movement of a door, wherein the device comprises:

a component assembly for detecting inward, outward and sideways door movement; and a support structure holding the component assembly, wherein the component assembly comprises a first component extended or extendable from the support structure, and wherein the first component comprises:

a supported end pivotable at the support structure; and a distal end for contacting a door face when the support structure is arranged in proximity to the door face and when the first component is extended from the support structure.

2. The device of claim 1, wherein the first component further comprises an elastic element affecting inward and outward movement of the first component relative to the support structure.

3. The device of claim 1, wherein the component assembly comprises a second component extending from the support structure which is distinct from the first component, and wherein the second component comprises:

a distal end for contacting a door face when the support structure is arranged in proximity to the door face; and an elastic element affecting inward and outward movement of the second component relative to the support structure.

4. The device of claim 1, wherein the component assembly comprises a second component which is distinct from the first component, and wherein the second component comprises a distance sensor.

5. The device of claim 1, wherein the first component comprises a cord having an adhesive or suction plate at its distal end.

6. The device of claim 1, wherein the first component comprises an end of a cord extending from a reel holding the cord.

7. The device of claim 1, further comprising an accelerometer attached to the support structure.

8. The device of claim 1, further comprising a vibration sensor attached to the support structure.

9. A system, comprising:

a portable floor stand;

a door movement sensor fixedly attached to the portable floor stand;

a proximity sensor comprising the door movement sensor or the portable floor stand; and an electronic user interface, wherein the system is configured to transmit a first electronic signal from the proximity sensor to the electronic user interface when the proximity sensor has been placed a predetermined distance from a door face, and wherein the system is configured to transmit a second electronic signal from the door movement sensor to the electronic user interface when movement of the door occurs, and wherein the electronic user interface is configured to:

upon receiving the first electronic signal, output first information to a user of the system which indicates the proximity sensor has been placed the predetermined distance from the door face; and upon receiving the electronic second signal output second information to the user of the system which indicates door movement has occurred.

10. The system of claim 9, further comprising an apparatus discrete from the portable floor stand, wherein the electronic user interface comprises input controls in wireless communication with the apparatus for starting and stopping operation of the apparatus.

11. The system of claim 10, wherein the apparatus comprises a wireless signal transmitter configured to transmit to the electronic user interface a third electronic signal when operation of the apparatus starts and a fourth electronic signal when operation of the apparatus has terminated.

12. The system of claim 10, further comprising a wireless signal transmitter coupled to the door movement sensor or the portable floor stand, wherein the wireless signal transmitter is configured to transmit a fifth electronic signal to the apparatus to terminate operation thereof when movement of the door occurs.

13. The system of claim 12, wherein the portable floor stand, proximity sensor, door movement sensor and wireless signal transmitter comprise one of a plurality of assemblies of portable floor stands, associated proximity sensors, door movement sensors and wireless signal transmitters, and wherein each of the wireless signal transmitters of the plurality of assemblies is configured to send a sixth electronic signal to the apparatus when the proximity sensor of the assembly has been placed a predetermined distance from a door face.

14. The system of claim 13, wherein the apparatus comprises a processor and a storage medium having program instructions which are executable by the processor for deterring operation of the apparatus until electronic signals from wireless signal transmitters of each of a preset number of the assemblies are received indicating proximity sensors associated with the assemblies have been placed a predetermined distance from a door face.

15. The system of claim 10, further comprising a portable communications device, wherein the apparatus and/or portable floor stand comprise a wireless signal transmitter configured to transmit a seventh electronic signal to the portable communications device when operation of the apparatus has terminated.

16. The system of claim 9, wherein the door movement sensor comprises a component extended or extendable from the portable floor stand, and wherein the component comprises a distal end for contacting a door face when the portable floor stand is arranged in proximity to the door face and when the component is extended from the portable floor stand.

17. The system of claim 9, wherein the door movement sensor comprises a distance sensor.

18. An apparatus, comprising:

a wireless signal receiver;

a processor; and a storage medium having program instructions which are executable by the processor for:

receiving input regarding a number of entryways of a room in which the apparatus is arranged;

recording receipt of a wireless signal from a door movement sensor device arranged in proximity to a face of a closed door to one of the entryways of the room; and inhibiting commencement of a task by the apparatus until the number of recorded signal receipts equals the number of entryways.

19. The apparatus of claim 18, wherein the storage medium further comprises program instructions which are executable by a processor for automatically starting operation of the task upon determining the number of recorded signal receipts equals the number of entryways.

20. A device for detecting movement of a door, wherein the device comprises:

a component assembly for detecting inward, outward and sideways door movement;

a support structure holding the component assembly, wherein the component assembly comprises a first component extended or extendable from the support structure, and wherein the first component comprises a distal end for contacting a door face when the support structure is arranged in proximity to the door face and when the first component is extended from the support structure; and an accelerometer attached to the support structure.

21. The device of claim 20, wherein the support structure is a floor stand.

22. The device of claim 20, wherein the support structure comprises an electronic user interface.

23. A device for detecting movement of a door, wherein the device comprises:

a component assembly for detecting inward, outward and sideways door movement;

a support structure holding the component assembly, wherein the component assembly comprises a first component extended or extendable from the support structure, and wherein the first component comprises a distal end for contacting a door face when the support structure is arranged in proximity to the door face and when the first component is extended from the support structure; and a vibration sensor attached to the support structure.

24. The device of claim 23, wherein the support structure is a floor stand.

25. The device of claim 23, wherein the support structure comprises an electronic user interface.

26. A device for detecting movement of a door, wherein the device comprises:

a component assembly for detecting inward, outward and sideways door movement; and a support structure holding the component assembly, wherein the component assembly comprises a first component extended from the support structure, and wherein the first component comprises;

a supported end pivotable at the support structure; and a distal end in contact with a door face.

27. The device of claim 26, wherein the first component further comprises an elastic element affecting inward and outward movement of the first component relative to the support structure.

28. The device of claim 26, wherein the component assembly comprises a second component extending from the support structure which is distinct from the first component, and wherein the second component comprises:

a distal end in contact with the door face; and an elastic element affecting inward and outward movement of the second component relative to the support structure.

29. The device of claim 26, wherein the component assembly comprises a second component which is distinct from the first component, and wherein the second component comprises a distance sensor.

30. The device of claim 26, wherein the first component comprises a cord having an adhesive or suction plate at its distal end.

31. The device of claim 26, wherein the first component comprises an end of a cord extending from a reel holding the cord.

32. The device of claim 26, further comprising an auxiliary sensor attached to the support structure for detecting movement of the support structure.

33. A device for detecting movement of a door, wherein the device comprises:

a component assembly for detecting inward, outward and sideways door movement; and a floor stand holding the component assembly, wherein the component assembly comprises a first component extended or extendable from the floor stand, wherein the first component comprises a distal end for contacting a door face when the floor stand is arranged in proximity to the door face and when the first component is extended from the floor stand.

34. The device of claim 33, wherein the floor stand comprises warning and/or usage signs to deter an individual from entering a room when the floor stand is in placed in proximity to a door face of the room.

35. The device of claim 33, wherein the floor stand further comprises an electronic user interface.

36. The device of claim 33, further comprising a gyroscope attached to the floor stand.

* * * * *

UNITED STATES PATENT AND TRADEMARK OFFICE

CERTIFICATE OF CORRECTION

PATENT NO. : 8,872,669 B2
APPLICATION NO. : 13/171063
DATED : October 28, 2014
INVENTOR(S) : Stibich et al.

It is certified that error appears in the above-identified patent and that said Letters Patent is hereby corrected as shown below:

IN THE CLAIMS:

Claim 34, col. 15, line 7: after the phrase "floor stand is in" delete "placed in".

Signed and Sealed this
Fifth Day of May, 2015

Michelle K. Lee

Michelle K. Lee
*Director of the United States Patent and Trademark Office*